US008935892B2

(12) United States Patent
Buchanan et al.

(10) Patent No.: US 8,935,892 B2
(45) Date of Patent: Jan. 20, 2015

(54) ENGINEERED WOOD CONSTRUCTION SYSTEM FOR HIGH PERFORMANCE STRUCTURES

(75) Inventors: Andrew Buchanan, Christchurch (NZ); Stefano Pampanin, Christchurch (NZ); Allesandro Palermo, Varese (IT)

(73) Assignee: Prestressed Timber Limited, Christchurch (NZ)

( * ) Notice: Subject to any disclaimer, the term of this patent is extended or adjusted under 35 U.S.C. 154(b) by 0 days.

(21) Appl. No.: 13/471,528

(22) Filed: May 15, 2012

(65) Prior Publication Data

US 2013/0019545 A1 Jan. 24, 2013

Related U.S. Application Data

(63) Continuation of application No. 12/376,687, filed as application No. PCT/NZ2007/000206 on Aug. 7, 2007, now abandoned.

(30) Foreign Application Priority Data

Aug. 7, 2006 (NZ) ..... 549029

(51) Int. Cl.
*E04B 1/98* (2006.01)
*E04H 9/02* (2006.01)
(Continued)

(52) U.S. Cl.
CPC ..... *E04B 1/10* (2013.01); *E04B 2001/2644* (2013.01); *E04B 2001/3583* (2013.01)
USPC ..... 52/167.4; 52/573.1; 52/713; 52/231; 52/223.14; 52/146; 52/148; 52/223.13; 248/560; 248/562

(58) Field of Classification Search
CPC ..... E04B 1/26; E04B 1/38; E04B 2/7407; E04B 2/3583; E04H 9/14
USPC ..... 52/167.1–167.9, 146, 152, 148, 52/DIG. 11, 247, 223.14, 231, 573.1, 576, 52/713, 223.13; 248/560, 562, 575
See application file for complete search history.

(56) References Cited

U.S. PATENT DOCUMENTS 2,837,776 A * 6/1958 Klein ..... 52/73
3,226,894 A * 1/1966 Burchardt et al. ..... 52/223.5
(Continued)

FOREIGN PATENT DOCUMENTS

JP 2002-364071 12/2002
JP U311286 6/2005
(Continued)

OTHER PUBLICATIONS

Japanese Examination Report, JP Appln. No. 2009-523741, Jun. 25, 2012, pp. 1.

*Primary Examiner* — Chi Q Nguyen
(74) *Attorney, Agent, or Firm* — Dann, Dorfman, Herrell and Skillman, P.C.

(57) ABSTRACT

A building includes a connection between an engineered wood load bearing element of the building such as a column, beam, or load bearing panel, and another load bearing element or a foundation of the building. At least one tendon ties the load bearing elements or the load bearing element and the foundation together. One or more energy dissipaters, replaceably connected between the load bearing element and/or the foundation, absorb energy when a loading event causes relative movement of the connection. The engineered wood element may be a laminated veneer lumber element, a parallel strand lumber element, or a glue laminated timber element, for example. Typically all of the load bearing elements of the building will be engineered wood elements. The building may be single or multi-storey. The building system enables lightweight low cost buildings, with energy dissipaters which may be replaced after extreme loading. The building may be prefabricated.

33 Claims, 9 Drawing Sheets

(51) Int. Cl.

| | |
|---|---|
| ***E04B 1/10*** | (2006.01) |
| *E04B 1/26* | (2006.01) |
| *E04B 1/35* | (2006.01) |

(56) References Cited

U.S. PATENT DOCUMENTS

| | | | | | |
|---|---|---|---|---|---|
| 3,979,863 | A | * | 9/1976 | Hurley et al. | 52/92.1 |
| 4,059,931 | A | * | 11/1977 | Mongan | 52/79.12 |
| 4,249,354 | A | * | 2/1981 | Wynn | 52/438 |
| 4,275,537 | A | * | 6/1981 | Pinson | 52/223.8 |
| 4,875,314 | A | * | 10/1989 | Boilen | 52/167.1 |
| 4,956,947 | A | * | 9/1990 | Middleton | 52/1 |
| 5,123,220 | A | * | 6/1992 | Simenoff | 52/252 |
| 5,168,681 | A | * | 12/1992 | Ayrapetyan | 52/223.7 |
| 5,384,993 | A | * | 1/1995 | Phillips | 52/92.2 |
| 5,386,671 | A | * | 2/1995 | Hu et al. | 52/167.3 |
| 5,459,973 | A | * | 10/1995 | Baumann | 52/848 |
| 5,531,054 | A | * | 7/1996 | Ramirez | 52/741.1 |
| 5,535,561 | A | * | 7/1996 | Schuyler | 52/223.13 |
| 5,657,597 | A | * | 8/1997 | Loftus | 52/274 |
| 5,669,189 | A | * | 9/1997 | Logiadis et al. | 52/167.4 |
| 5,675,943 | A | * | 10/1997 | Southworth | 52/167.1 |
| 6,014,843 | A | * | 1/2000 | Crumley et al. | 52/167.3 |
| 6,161,339 | A | * | 12/2000 | Cornett et al. | 52/23 |
| 6,195,949 | B1 | * | 3/2001 | Schuyler | 52/223.13 |
| 6,256,943 | B1 | * | 7/2001 | Mander et al. | 52/167.1 |
| 6,282,859 | B1 | * | 9/2001 | Van Der Heijden | 52/585.1 |
| 6,557,316 | B2 | * | 5/2003 | Van Der Heijden | 52/585.1 |
| 7,150,132 | B2 | * | 12/2006 | Commins | 52/293.3 |
| 7,313,890 | B2 | * | 1/2008 | Clarke | 52/233 |

FOREIGN PATENT DOCUMENTS

| | | |
|---|---|---|
| JP | 2005-282231 | 10/2005 |
| JP | 2006-063771 | 3/2006 |
| JP | 2006-083545 | 3/2006 |

* cited by examiner

ENGINEERED WOOD CONSTRUCTION SYSTEM FOR HIGH PERFORMANCE STRUCTURES

This application is a continuation of U.S. application Ser. No. 12/376,687 filed Feb. 6, 2009, now abandoned, which was the National Stage of International Application No. PCT/NZ2007/000206, filed Aug. 7, 2007, the entireties of which are incorporated herein by reference.

FIELD OF THE INVENTION

The invention relates to a prestressed engineered wood building construction system which provides protection against extreme loading events such as seismic events or high wind loading or exceptional gravity loading on the building.

BACKGROUND

Over approximately the last decade there has been increased work on the design and development of construction systems for multi-storey concrete and steel buildings for regions subject to seismic activity, which not only prevent catastrophic failure of the building and protect life, but which also enable buildings to withstand earthquakes without structural damage, so as to reduce the economic cost of building repair and/or reconstruction as well as minimising business interruption (downtime) after an earthquake.

In some cases very strong winds including cyclones can also cause building movement and structural damage.

SUMMARY OF INVENTION

The invention provides an improved or at least alternative construction system for a building which provides at least a degree of protection against seismic and/or wind loading events, with the objective of avoiding or minimising structural damage to the building following such a loading event.

In broad terms in one aspect the invention comprises a building which includes:

a connection between an engineered wood load bearing element of the building and another load bearing element or a foundation of the building, at least one tendon tying the load bearing elements or the load bearing element and the foundation together, and at least one energy dissipater replaceably connected between the load bearing elements or load bearing element and the foundation, which will absorb energy from a loading event causing relative movement of the connection.

In one form the building comprises two or more storeys. In another form the building comprises a single storey.

In a preferred form the energy dissipater is connected between the load bearing elements or the load bearing element and the foundation externally as will be further described.

Typically the load bearing element or elements is/are one or more structural elements of the building such as beams, columns, or walls. Alternatively the load bearing elements may be floor panels, which also bear load. The floor panels may or may not be supported by beams and/or columns and/or walls. Lateral load resisting systems consist of frames (of beams and columns fixed to each other, with the columns fixed to the foundations), or walls (fixed to the foundations), or combinations of frames and walls. The floors tie the walls or frames to each other, and are supported on beams and/or columns and/or walls.

Thus the connection may be a beam to column connection such as a beam to column connection between one beam and one column, a beam to column connection between a column and beams on two opposite (or more) sides of the column, or a corner beam to column connection with two beams connected to a column and extending in different directions from the column. The term "beam" should be understood in this specification to include a load bearing element whether horizontal or at an angle to be horizontal, which supports a roof, such as a roof-supporting structural element commonly referred to as a roof truss for example. Alternatively the connection may be a column to foundation connection, a wall to foundation connection where the wall element is a load bearing element, or a connection between adjacent wall elements such as wall panels where the wall panels are load bearing elements, or a wall to beam connection, in a separated wall assembly accompanying beams between the walls for example, or a floor panel to beam or column or wall connection.

Typically the engineered wood beam, column or panel is of laminated veneer lumber (LVL). By a laminated veneer lumber element it is meant a beam, column or panel produced by bonding together wood veneers or layers of up to about 10 millimeters in thickness with the grain of at least the majority of the veneers extending generally in the longitudinal direction of the beam column or panel. Alternatively the engineered wood element may be a parallel strand lumber element. By a parallel strand lumber element is meant an element consisting of long veneer strands, at least the majority of which are laid in parallel, bonded together to form the element.

Alternatively the element may be a glue laminated timber element, by which is meant an element consisting of individual pieces of lumber having a thickness typically from about 10 to about 50 mm, end-joined together to create longer lengths which are in turn laminated together to form the element.

The connection or connections is/are tied together by one or more tendons. Preferably the tendons are unbonded (not fixed) to the elements along the length of the element, but they may be partially bonded by being fixed to the element(s) at spaced intervals. The tendons may be straight or may change direction along the elements. Typically the tendon(s) prestress the elements and the joint.

One or more dissipaters are replaceably connected between the elements at the connection(s), enabling the sacrificial dissipater or the functional component thereof which yields in tension or compression or bending to be replaced after a seismic or extreme wind loading event for example. Preferably the energy dissipater is fixed to the exterior of the elements as will be further described but alternatively the energy dissipater may be mounted within a bore or cavity internally between the connected wood elements, in such a way as to enable the dissipater or a major functional part thereof to be removed and replaced.

During a seismic or extreme wind event of sufficient magnitude, controlled rocking motion occurs at the connection(s). For example a column or vertical load bearing wall panel connected to a base foundation in accordance with the invention may rock, or rocking may occur at a beam to column connection. During the rocking motion energy is dissipated by deformation of the replaceable energy dissipater while the tendons hold the connections together and self-centre or restore the connected elements to their original positions relative to one another at the conclusion of motion. Then the energy dissipaters may be replaced without requiring replacement of the engineered wood load bearing elements.

In one form the dissipater or dissipaters each comprise two plates fixed one to each of adjacent faces of two connected load bearing elements a bracket fixed to at least one plate or brackets fixed one to each plate or to and through each plate to the load bearing element, the brackets having a footprint on a face of the plate smaller than the area of the face of the plate, and a functional part connected between the load bearing elements via the bracket or brackets which will deform to absorb energy during seismic motion. In a preferred form the functional part comprises a longitudinally extending element which is removably fixed at its either end to the bracket(s). Alternatively the dissipater may be a bending element or a large number of fasteners such as nails.

The term 'comprising' as used in this specification and claims means 'consisting at least in part of', that is to say when interrupting independent claims including that term, the features prefaced by that term in each claim will need to be present but other features can also be present.

BRIEF DESCRIPTION OF THE FIGURES

The invention is further described with reference to the accompanying figures which show various embodiments of the invention by way of example and without intending to be limiting. In the figures.

DETAILED DESCRIPTION OF EMBODIMENTS

Figure 1:
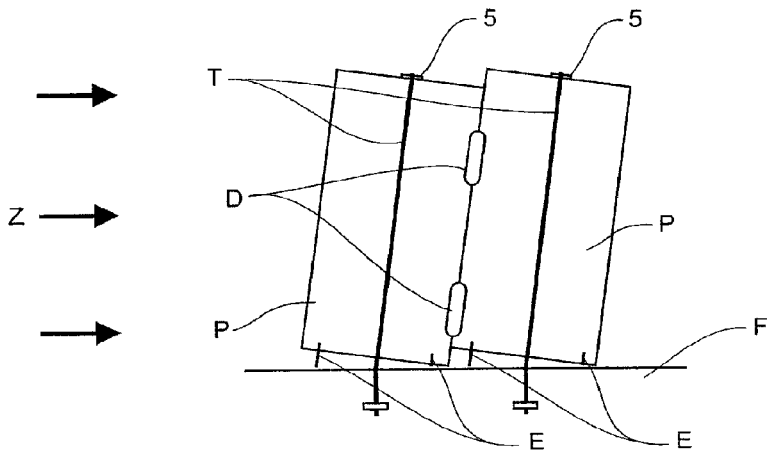
FIGS. 1 and 2 show walls of load bearing panels.
Figure 2:
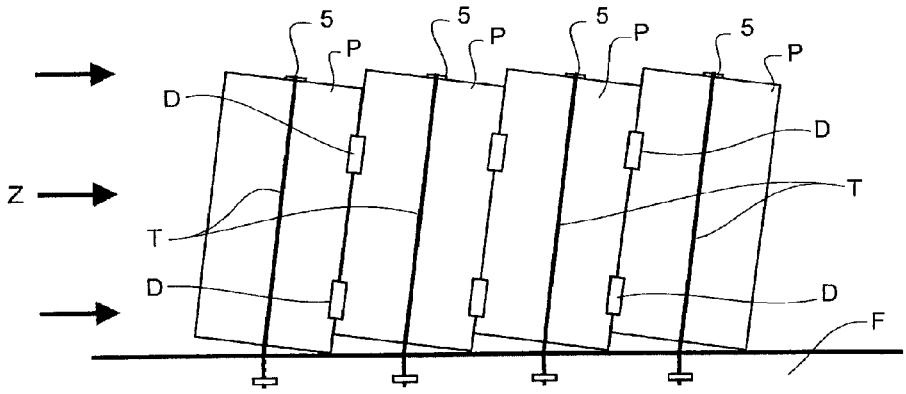

FIG. 1 shows two load bearing wall panels P formed of engineered wood such as LVL. FIG. 2 shows four such wall panels. The wall panels P stand on a foundation F. The wall panels are tied to the foundation by tendons T. Typically a tendon T comprises a rod or bar or wire or group thereof, or a cable of steel or alloy or carbon fibre or other high tensile strength material. A tendon T passes through a longitudinally extending cavity through each wall panel P. The tendons T are fixed in or to the foundation F, and at the top of the wall panels P by being anchored to an anchoring device 5. For example a threaded end of each tendon may pass through a plate and be secured with a bolt on the other side. This also enables the prestress force applied by the tendon to be adjusted, and enables the prestress force in the tendon to be increased/adjusted at intervals during the life of the building. Anchoring devices in other forms may be utilised, which preferably also allow for adjustment of pre-stress applied by the tendon(s). The tendons T are otherwise unbonded (not fixed) to the panels P along the length of the panels. In an alternative embodiment the tendons may be partially bonded by being fixed to the panels P at spaced intervals or continuously, along the length of the tendons T.

Energy dissipation devices or dissipaters D are provided in between the longitudinal edges of adjacent wall panels P. The energy dissipation devices D are accessible from at least one side of the wall panels so that they can be replaced after a seismic or other loading event without requiring removal or replacement of the panels P. Energy dissipaters E (shown in FIG. 1 but not FIG. 2) may also be provided between the bottom edge of the wall panels P and the foundation F. The dissipaters E are also accessible so that they can be replaced after a loading event, for example as subsequently described with reference to FIG. 13. Normally the wall panels P stand centred on the foundation F. During a seismic or other loading event the panels are free to rock as shown in FIGS. 1 and 2, which show the wall panels P rocking to one side under the influence of force in the direction of arrows Z.

During such rocking motion the energy dissipaters D and dissipaters E if provided absorb energy, typically by deformation of the dissipaters or a functional part thereof. The dissipaters damp motion between the load bearing elements. The dissipaters may be in any form which will absorb energy, typically through yielding of the dissipater or a functional component thereof by bending for example. Alternatively the dissipater(s) may absorb energy via friction sliding between two parts of the dissipater, or viscous damping action. The tendons T tie the load bearing panels P in place but allow the rocking motion to occur during a loading event of sufficient magnitude. After the loading event the dissipaters may be replaced if necessary, without requiring removal or replacement of the panels P. Typically the dissipaters are accessible from the exterior of the panels (examples are described subsequently) enabling the dissipaters to be unfixed, removed and replacement dissipaters fixed in place readily. Alternatively the dissipaters may be mounted within a cavity internally between the connected load bearing elements, such as a cavity between edges of adjacent panels P, in such a way as to enable the dissipater or the major functional part of the dissipater to be accessed and removed and replaced after a loading event The tendons T may if necessary be re-tensioned, if the tendons have stretched during the rocking motion for example, or replaced if any tendon has broken.

Figure 3A:
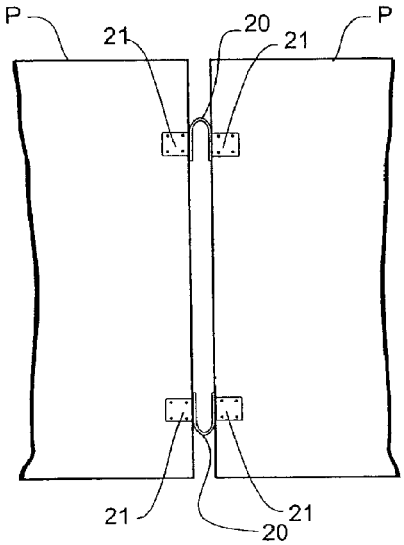
FIGS. 3*a-d* show one form of energy dissipater for use between adjacent wall panels.
Figure 3B:
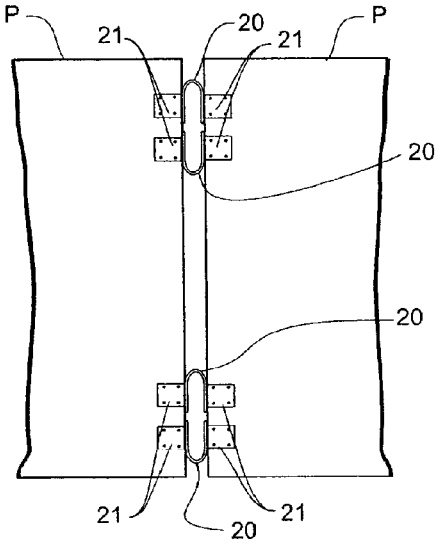

FIGS. 3*a*-3*d* show one form of energy dissipater D for use between adjacent wall panels as in FIGS. 1 and 2 in more detail. Each dissipater consists of U-shaped length 20 of a bent steel plate anchored to each wall panel. The U-shaped part 20 is the major functional component of the dissipater. In the embodiment shown each end of this functional component 20 is anchored to one or more right-angle shaped mounting plate 21 between the panel edges. The other arm of each mounting plate 21 overlies the external face of panel P, and has holes by which the dissipater is bolted to the panels P on either side. FIG. 3*a* shows two such dissipaters mounted between two adjacent panels P at spaced locations. FIG. 3*b* shows two dissipaters mounted at each location, between panels P.

Figure 3C:
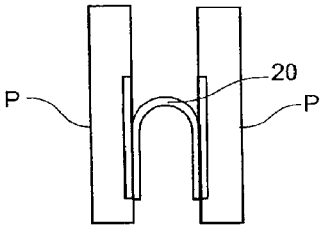
Figure 3D:
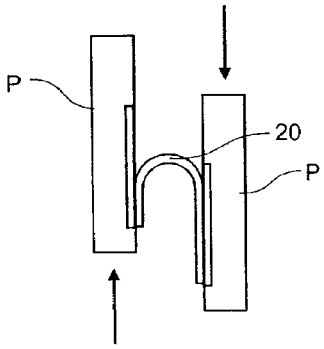

FIGS. 3*c* and 3*d* schematically illustrate how the dissipater of FIGS. 3*a* and *b* functions. FIG. 3*c* schematically shows the dissipater under no-load or normal conditions. FIG. 3*d* shows the dissipater during rocking motion between the panels, in one direction. As the panels rock, moving one panel relative to the other, the metal functional part 20 of the dissipater yields or deforms, in doing so absorbing energy and dampening the rocking motion. When the panels rock back in the opposite direction the dissipater will yield in the opposite direction. When the panels return to their normal position, centred on the foundation, the dissipater will be deformed back to its normal position shown in 3*c*. After the loading event the dissipaters may be inspected, and replaced if necessary. This form of dissipater dissipates energy by progressive bending along its length as the panels P rock during seismic motion.

The dissipaters E in FIGS. 1 and 2 are fixed between the bottom edge of the panels P and the foundation F, and may for example be metal components which will yield in tension and preferably in both tension and compression, during rocking motion of the panels, and then return to their original condition. Again the dissipaters E are accessible so that they can be inspected and replaced if necessary after a loading event.

Alternatively, the dissipaters D and E may be viscous dampers, or lead extrusion dampers for example.

Figure 4A:
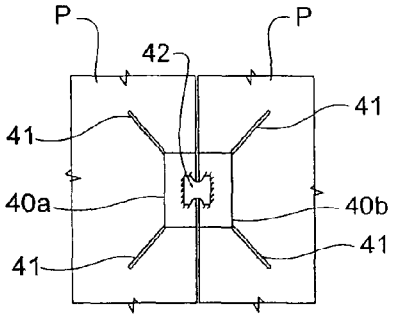
FIGS. 4*a-e* show alternative forms of dissipaters for use between adjacent wall panels.
Figure 4B:
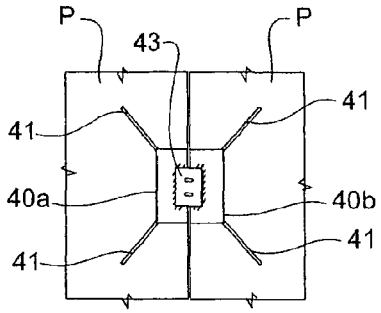
Figure 4C:
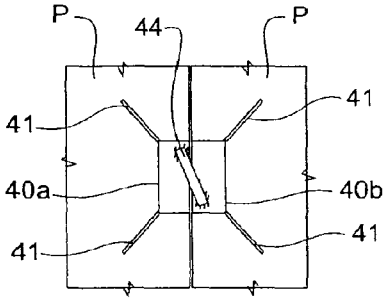
Figure 4D:
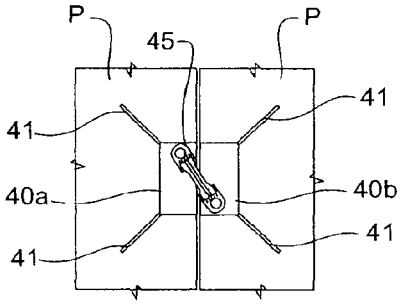
Figure 4E:
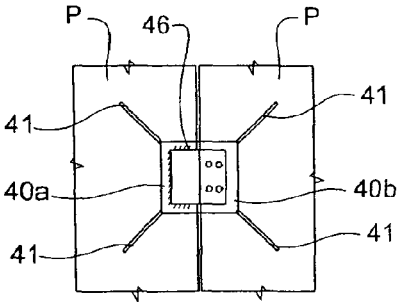

FIGS. 4*a-e* show five further forms of dissipaters for use between adjacent panels. The figures show left and right parts of two adjacent panels P, looking at the panels side on in each case. In each case the dissipater comprises a plate-like part 40*a* on one side and a similarly shaped right plate-like part 40*b* on the other side, which are fixed to the left and right panels P, for example by being screwed or bolted into the panel and/or through rebar anchors 41 glued into angled slots in the panel surface as shown. The dissipater of FIG. 4*a* comprises a notched shear plate 42 welded to and between the parts 40*a* and 40*b* of the dissipater. The dissipater of FIG. 4*b* comprises a slotted flexure plate 43 similarly welded between the plates 40*a* and 40*b*. The dissipater of FIG. 4*c* comprises an inclined bar element 44 welded across the plates 40*a* and 40*b* at an angle as shown—the inclined bar 44 is welded to the plates 40*a* and 40*b* at its ends. In the dissipater of FIG. 4*d* a pinned tension strut 45 extends between the dissipater parts 40*a* and 40*b* and is bolted to part 40*a* at one end and to part 40*b* at the other end of the strut. In the dissipater of Fige a plate 46 is welded to one dissipater part 40*a* and is bolted to the right hand dissipater part 40*b*. The holes in the plate 46 through which the bolts pass are elongate slots, so that under extreme loading the plate 46 can slide relative to the dissipater part 40*b*, so that the dissipater provides a vertical friction joint.

Figure 5:
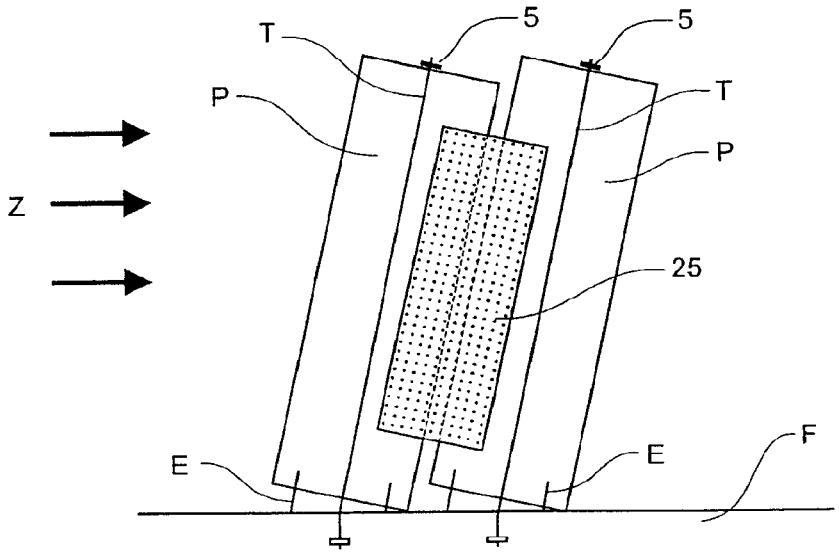
FIG. 5 shows another form of dissipater between adjacent wall panels.

FIG. 5 shows another form of dissipater for use between adjacent wall panels P. In FIG. 5 panels P, foundation F, and tendons T are indicated as before. A sheet of material 25 is fixed across the adjacent longitudinal edges of adjacent panels P, by metal fasteners which pass into the panel P on either side. For example the panel 25 may be a plywood sheet and the metal fasteners may be nails, the plywood sheet being nailed by many nails into engineered wood panels P on either side, for example at least 20, preferably 50 or more nails on either side. During rocking motion the nails will be bent, absorbing energy. After the loading event, the sheet 25 may be pulled from the panels P, and readily replaced by re-nailing back in place. Alternatively to nails the metal fasteners may be screws or bolts, which will yield during a loading event, and the panel 25 may be a metal plate for example. FIG. 5 shows a single length of material extending over a major part of the height of the panels P but in an alternative embodiment a number of smaller panels or plates 25 may be nailed or fixed between the panels P at spaced locations over the height of the panels.

Figure 6:
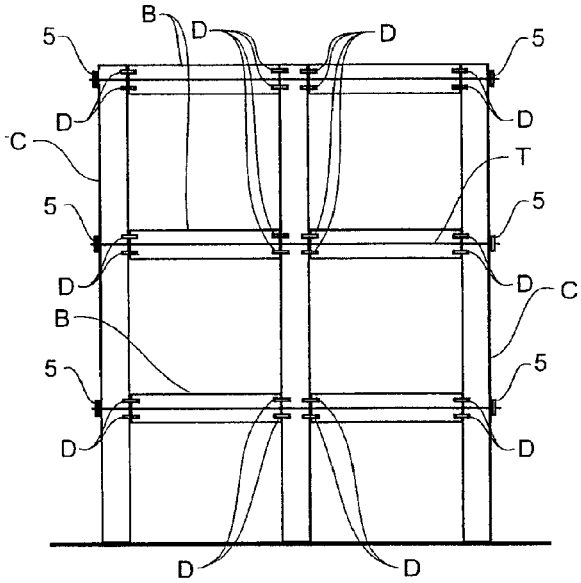
FIGS. 6 and 7 show frames for multi-storey buildings.

FIG. 6 shows a multi-storey frame for a building, comprising beams B and columns C of engineered wood, which are connected according to the invention. Tendons T pass through cavities extending horizontally through the beams B and are fixed to opposite faces of the columns C to tie the beams to the columns. Two energy dissipaters D are fixed across the connection between each beam B and column C on each vertical side. In some cases there are beam to column connections between a column and beams on two opposite (or more) sides of the column, at each storey of the building. In the case of corner columns there are connections between two beams connected to a column and extending in different directions from the column, at each storey of the building. Dissipaters are connected between the beams and columns at each such connection. The columns may be connected to the foundation via dissipaters as described with reference to FIG. 13 for example, or alternatively the columns may sit in sockets or recesses in the foundation.

Figure 7:
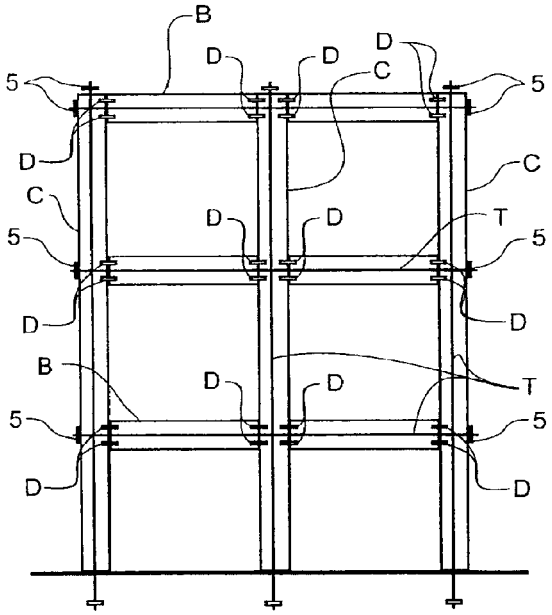

FIGS. 6 and 7 show multi-storey buildings but the building in another form may be a single storey building comprising column-beam connections between columns of the single storey building and roof supporting beams (commonly referred to as roof trusses). In an alternative form again the connections may be between single storey walls comprising load bearing panels, as described with reference to FIGS. 1 and 2, and horizontal or angled roof beams which sit atop the upper edges of the wall panels.

FIG. 7 shows an alternative three storey frame for a building similar to that of FIG. 6, comprising beams B and columns C of engineered wood, in which tendons T also pass through vertical cavities such as bores through each of the columns C and are fixed to the foundation F at one end and are anchored at the upper ends of the columns C at their other end.

Figure 8:
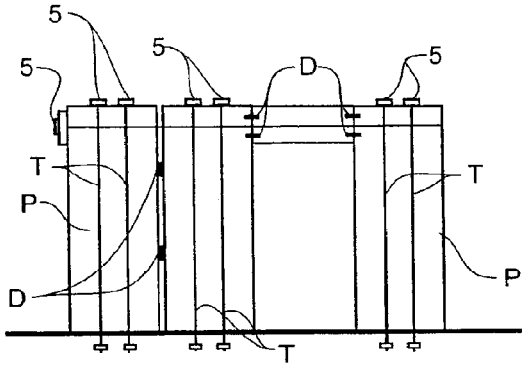
FIG. 8 shows part of a building wall comprising a beam coupled between load bearing wall panels.

FIG. 8 shows a beam B coupled between separated load bearing wall panels P. As described with reference to FIGS. 1 and 2 tendons T pass vertically through cavities in the panels P and tie the panels to foundation F. One or more tendons T also pass horizontally through the beam B and all panels P and tie the beam and panels together. Energy dissipaters D are mounted across the connection between the beam and panels at either end of the beam. Energy dissipaters D are also provided between adjacent panels as described previously with reference to FIGS. 1 and 2. Energy dissipaters (not shown) may also be provided between the lower edges of the panels and the foundation F as described with reference to FIGS. 1 and 2.

Figure 9A:
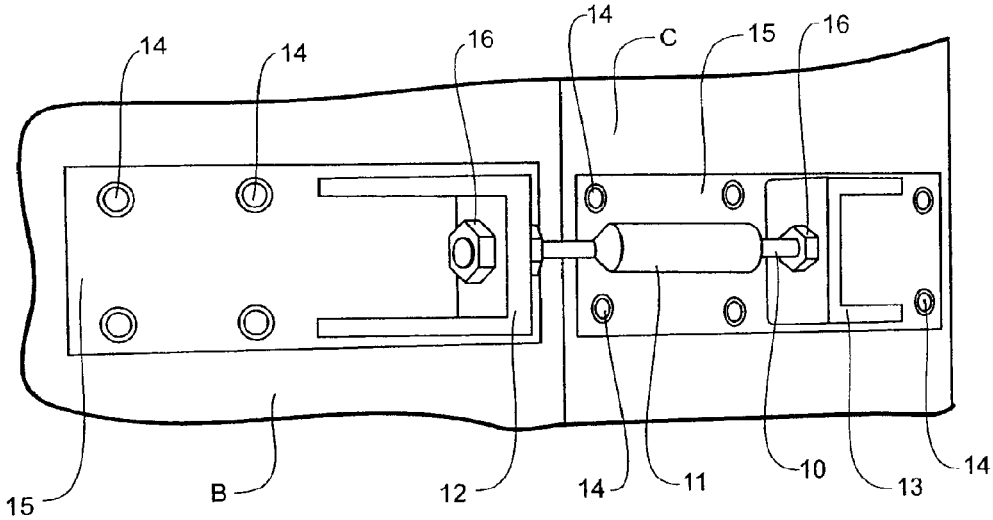
FIGS. 9*a* and 9*b* show one form of dissipater in more detail.
Figure 9B:
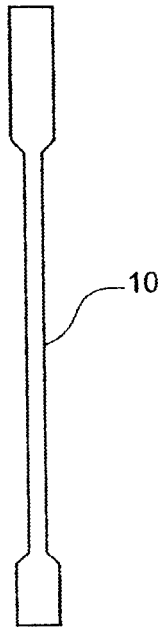

FIGS. 9*a* and 9*b* show one form of dissipater in more detail, for use at a joint between a beam B and column C. The dissipater comprises a rod or bar 10 of steel or other material which will yield to absorb energy during a loading event, which in the embodiment is shown necked down (reduced in diameter) in a central area (see FIG. 9*b*), so that the rod 10 will yield at this central area. In the particular embodiment shown this central area of the rod is covered with a tube 11 which is bonded to the rod 10 for example by epoxy to restrain the necked section of the rod 10 against buckling. In an alternative embodiment the rod 10 could be of constant or varying diameter. The anti-buckling component 11 may not be essential—for example the rod 10 may be replaced by a bar or element having a cross-section shape such as a cross-shape, which will resist buckling under compression loading. The rod 10 is fixed at it's either end to high strength metal brackets 12 and 13 which are welded to plates 15 which are bolted to a side faces of beam B and column C by multiple bolts or screws 14 which thread into the engineered wood beam and column. The ends of the rod 10 may for example be threaded. Nuts 16 on the threaded ends of the steel dissipater rod fix the rod between the brackets 12 and 13, and may be tightened sufficiently to tension the rod 10, so that the rod will deform in tension and/or compression during a seismic event. Two or more such dissipaters may be fixed adjacent each other across a beam to column joint on one side. One or two or more such dissipaters may also be provided on the opposite face of the joint. The dissipaters may be flush mounted in a recess across the joint, cut into the wood loaded bearing elements.

FIGS. 10 to 13 show further alternative and simple forms of dissipaters.

Figure 10:
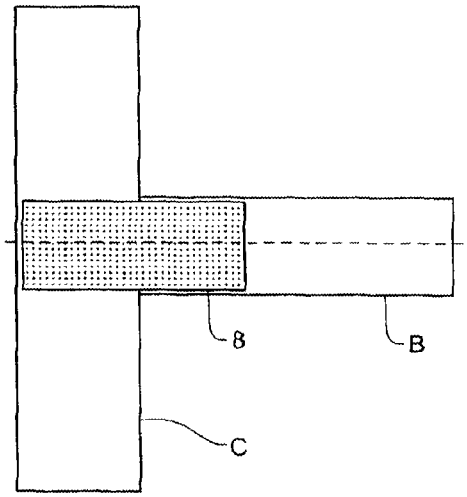
FIGS. 10 to 13 show alternative forms of dissipaters between beam and column or column or wall panel and foundation connections.
Figure 11:
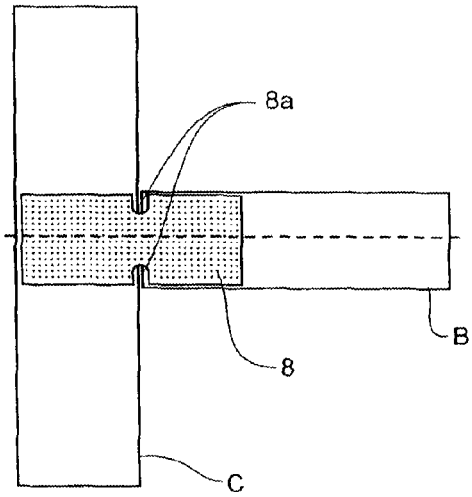
Figure 12:
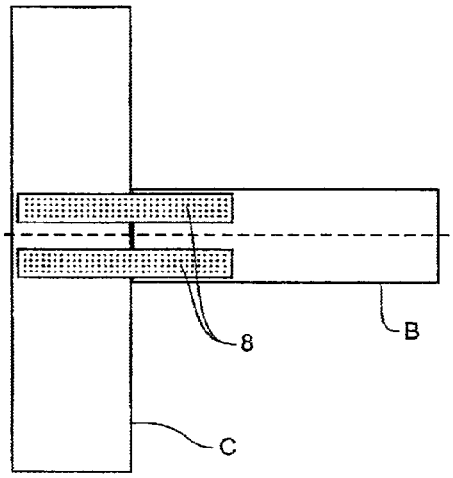

FIGS. 10 to 12 show beam to column joints with one beam B attached to the column C. Alternatively there may be beams attached to two or more faces of the column. In FIG. 10 the dissipater comprises a metal plate 8 such as a steel plate or alternatively a plywood plate which is nailed to the end of the beam and to the column by multiple nails (not shown) passing through the plate 8 and into the external face of the beam and column. Alternatively multiple screws or bolts may be threaded through the plate and into the beam or column. The steel plate 8 shown in FIG. 11 is fixed to the beam end and column in the same way but is also notched or of reduced width at 8*a* as shown. A matching plate 18 may be provided on the opposite side of the joint in each case. The plates may sit directly on the timber surface or be recessed into the timber surface to sit flush. They may alternatively be fixed by bonded steel plugs through the plates and into the timber or embedded, bonded rods or bolts. In the joints shown in FIGS. 11 to 13 energy may be absorbed either by yielding of the nailed or screwed connections between the plates and the wood. Alternatively energy may be absorbed by yielding of the plates 8 if made of metal. If it is intended that energy is absorbed by yielding of the plates, the plates may be formed so as to have a narrower dimension, preferably aligned with the interface between the two connected load bearing elements, formed for example by notches 8*a* shown in FIG. 11.

FIG. 12 shows an embodiment in which two separate plates are fixed across a connection between beam B and column C.

Figure 13:
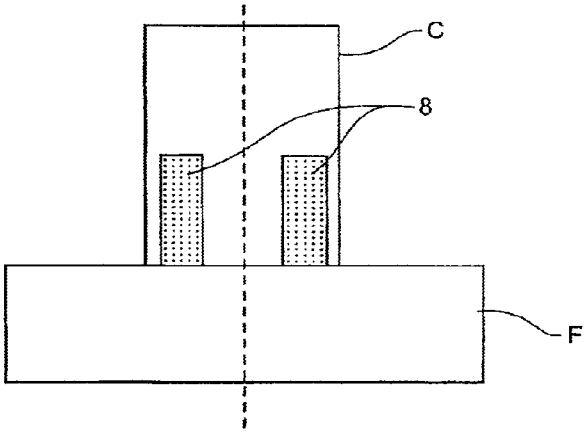

FIG. 13 shows steel plates 8 fixed as dissipaters, between a column C or wall panel and a foundation F. The plates 8 may be in two parts—a lower part, cast into a concrete foundation for example with an exposed end, and a replacable upper part bolted or otherwise fixed to this exposed end and nailed or screwed or bolted to the column. Plates may be provided on multiple sides of the column end, into the foundation. During a loading event causing rocking of the column C or wall panel the steel plates will deform to damp motion and absorb energy. In some of the embodiments described above the dissipaters comprise steel rods bolted to steel brackets which are fixed to the structural elements, or are in turn fixed to steel plates fixed to the structural elements. The steel rods yield in tension and compression with anti-buckling restraint. They absorb energy during yielding. In other embodiments the dissipaters comprise steel plates which yield during a loading event. In alternative forms however, the dissipaters may comprise viscous damping devices, including extrusion devices fixed to the structural elements. The dissipaters may also comprise friction devices such as slotted bolted connections between steel plates. All these types of dissipater may be made from steel or from alloys or other materials. In a further embodiment the energy dissipaters may be steel rods glued into holes in the structural elements, or glued into holes in blocks of wood attached to the structural elements. In this case the steel rods will be threaded steel rods or deformed reinforcing bars.

Typically all of the load bearing elements of the building will be engineered wood elements. However it is not intended to exclude that some of the load bearing elements may be formed of other materials. The connections may be between engineered wood columns and steel beams for example, or vice versa. In a preferred form all of the load bearing elements of the building are formed of engineered wood. In another form some of the load bearing elements are formed of engineered wood and some other elements are formed of solid wood or steel for example. The foundation F of the building will typically be a concrete pad. The building system of the invention enables the construction of lightweight low cost buildings, with energy dissipaters which may be replaced after extreme loading.

The building may be prefabricated before delivery to a construction site, by pre-forming the load bearing elements such as beams and/or columns and/or wall panels off site, to size. The components of the prefabricated building are delivered onsite, and the columns, beams, and/or panels put in place to form the frame of a single or multi-storey building, and the roof of the building is constructed. In such embodiments the invention provides a low cost modular prefabricated construction system forming pre-stressed non-concrete buildings, comprising protection against loading events such as earthquakes and extreme wind buffeting. The invention enables single and in particular multi-storey buildings to incorporating such protection, to be built in situations where cost may preclude the construction of a pre-stressed concrete structure.

The foregoing describes the invention including embodiments thereof. Alterations and modifications as would be obvious to those skilled in the art are intended to be incorporated in the scope hereof as defined in the accompanying claims.

The invention claimed is:

1. A building comprising:

a superstructure having a first engineered wood load bearing element;

an elongated cavity formed in said first engineered wood load bearing element along the length thereof;

a second load bearing element;

a high tensile strength tendon extending in the cavity of said first engineered wood load bearing element, said high tensile strength tendon having an end portion that protrudes from an end of the first engineered wood load bearing element and is connected to said second load bearing element;

an anchoring device for affixing the end portion of said high tensile strength tendon to said second load bearing element; and an energy dissipater connected between said first engineered wood load bearing element and said second load bearing element;

wherein the high tensile strength tendon is in a pre-stressed condition that provides a tensile connection between said first engineered wood load bearing element and the second load bearing element and that allows controlled rocking movement between the first engineered wood load bearing element and the second load bearing element during a seismic event.

2. A building as claimed in claim 1 wherein said second load bearing element is a foundation of the building.

3. A building as claimed in claim 1 wherein the second load bearing element comprises a second engineered wood load bearing element in said superstructure having:

a second elongated cavity formed therein along the length of said second load bearing element; and a second high tensile strength tendon extending in the second cavity, said second high tensile strength tendon having an end portion that protrudes from an end of the second engineered wood load bearing element and is connected to a third load bearing element in said superstructure;

wherein the second high tensile strength tendon is in a pre-stressed condition that provides a second tensile connection between said second engineered wood load bearing element and another load bearing element and that allows controlled rocking movement between the second engineered wood load bearing element and the other load bearing element during a seismic event.

4. A building as claimed in claim 3 wherein the second engineered wood load bearing element is a column or a beam in said superstructure.

5. A building according to claim 3 wherein the first and second engineered wood load bearing elements are beams in said superstructure.

6. A building according to claim 3 wherein one of the first and second engineered wood load bearing elements is a column in said superstructure.

7. A building according to claim 3 wherein one of the first and second engineered wood load bearing elements is a load bearing wall panel in said superstructure.

8. A building according to claim 1 wherein the tensile connection is a beam to beam connection.

9. A building according to claim 1 wherein the tensile connection is a beam to column connection.

10. A building according to claim 1 wherein the tensile connection is between adjacent load bearing wall panels.

11. A building according to claim 1 wherein the tensile connection is between a load bearing wall panel and a beam.

12. A building according to claim 1 wherein the tensile connection is between a load bearing wall panel and a column.

13. A building according to claim 1 wherein the building comprises beam to column connections between a column and beams on two or more sides of the column.

14. A building according to claim 1 wherein the building comprises beam to column connections between a corner column and two beams extending in different directions from the column.

15. A building according to claim 1 wherein the high tensile strength tendon is unbonded to the engineered load bearing element or elements along the length of the element or elements.

16. A building according to claim 1 wherein the high tensile strength tendon is partially bonded to the first engineered wood load bearing element by being fixed to the first engineered wood load bearing element at spaced intervals along the length of the first engineered wood load bearing element.

17. A building according to claim 1 wherein the energy dissipater is constructed to deform to absorb energy during a seismic loading event.

18. A building according to claim 1 wherein the energy dissipater is replaceably affixed to an exterior of the load bearing elements.

19. A building according to claim 1 wherein the energy dissipater is mounted within a cavity internally between the load bearing elements so as to enable the dissipater or a major functional part thereof to be removed and replaced after a loading event.

20. A building according to claim 1 wherein the first engineered wood element is a laminated veneer lumber element.

21. A building according to claim 1 wherein the first engineered wood element is a parallel strand lumber element.

22. A building according to claim 1 wherein the first engineered wood element is a glue laminated timber element.

23. A building according to claim 1 comprising two or more stories.

24. A building comprising:

a superstructure having a plurality of engineered wood load bearing columns and a plurality of engineered wood load bearing beams, said plurality of engineered wood load bearing columns and said plurality of engineered wood load bearing beams being primary structural elements of the building;

an elongated cavity formed in each of said engineered wood load bearing columns and in each of said engineered wood load bearing beams along the lengths thereof;

a plurality of high tensile strength tendons extending in the cavities of said engineered wood load bearing columns and in the cavities of said engineered wood load bearing beams, each of said high tensile strength tendons having an end portion that is connected to one of said engineered wood load bearing columns, or to one of said engineered wood load bearing beams;

a plurality of anchoring devices that affix the end portions of said high tensile strength tendons to said engineered wood load bearing columns and beams; and a plurality of energy dissipaters each connected between engineered wood load bearing columns, between engineered wood load bearing beams, or between an engineered wood load bearing beam and an engineered wood load bearing column;

wherein the plurality of high tensile strength tendons are in a pre-stressed condition that provide tensile connections between respective engineered wood load bearing columns, between respective engineered wood load bearing beams, or between engineered wood load bearing beams and engineered wood load bearing columns and that allow controlled rocking movement between the respective engineered wood load bearing columns, between the respective engineered wood load bearing beams, or between the engineered wood load bearing beams and the engineered wood load bearing columns during a seismic event.

25. A building according to claim 24 wherein the engineered wood load bearing columns and the engineered wood load bearing beams comprise laminated veneer lumber.

26. A building according to claim 24 wherein the engineered wood load bearing columns and the engineered wood load bearing beams comprise parallel strand lumber.

27. A building according to claim 24 wherein the engineered wood load bearing columns and the engineered wood load bearing beams comprise glue laminated timber.

28. A building according to claim 24 wherein said tensile connections extend between all or most of the engineered wood load bearing columns and the engineered wood load bearing beams of the building.

29. A building according to claim 24 wherein all or substantially all connections between the engineered wood load bearing columns and a foundation of the building comprise at least one energy dissipater.

30. A building according to claim 24 comprising two or more stories.

31. A building which includes:

a superstructure having a plurality of engineered wood load bearing wall panels that are primary structural elements of the building;

an elongated cavity formed in each of said engineered wood load bearing wall panels along the lengths thereof;

a plurality of high tensile strength tendons extending in the cavities of said engineered wood load bearing wall panels, each of said high tensile strength tendons having an end portion that is connected to another of said engineered wood load bearing wall panels or to another load bearing structural element;

a plurality of anchoring devices that affix the end portions of said high tensile strength tendons to said engineered wood load bearing wall panels; and a plurality of energy dissipaters each connected between adjacent engineered wood load bearing wall panels;

wherein the plurality of high tensile strength tendons are in a pre-stressed condition that provide tensile connections between at least two of said engineered wood load bearing wall panels and that allow controlled rocking movement between respective engineered wood load bearing wall panels during a seismic event.

32. A building according to claim 31 comprising additional high tensile strength tendons that are in a pre-stressed condition that provides tensile connections between engineered wood load bearing wall panels and a foundation of the building.

33. A building according to claim 31 comprising additional energy dissipaters connected between engineered wood load bearing wall panels and a foundation of the building.

* * * * *